US007055713B2

(12) United States Patent
Rea et al.

(10) Patent No.: US 7,055,713 B2
(45) Date of Patent: Jun. 6, 2006

(54) EASY-OPENING CLOSURE FOR RETORTABLE CONTAINER

(75) Inventors: Keith Rea, Florence, SC (US); Lawrence E. Renck, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 10/292,842

(22) Filed: Nov. 12, 2002

(65) Prior Publication Data

US 2004/0089664 A1 May 13, 2004

(51) Int. Cl.
*B65D 17/40* (2006.01)

(52) U.S. Cl. ..... 220/276; 220/270

(58) Field of Classification Search ..... 220/266, 220/270, 276, 359, 359.3, 359.2
See application file for complete search history.

(56) References Cited

U.S. PATENT DOCUMENTS

| | | | | |
|---|---|---|---|---|
| 3,195,763 | A | 7/1965 | Fried et al. | |
| 3,195,764 | A | 7/1965 | Fried et al. | |
| 3,303,958 | A * | 2/1967 | Taylor | 220/270 |
| 3,463,348 | A | 8/1969 | Pound et al. | |
| 3,701,453 | A * | 10/1972 | Platt et al. | 220/270 |
| 3,784,048 | A | 1/1974 | McKernan | |
| 3,942,676 | A | 3/1976 | Beckers et al. | |
| 3,990,603 | A | 11/1976 | Brochman | |
| 4,078,694 | A * | 3/1978 | Gnyp et al. | 220/268 |
| 4,253,584 | A | 3/1981 | Bloeck et al. | |
| 4,637,543 | A | 1/1987 | Kücherer | |
| 4,890,759 | A * | 1/1990 | Scanga et al. | 220/273 |
| 4,940,158 | A * | 7/1990 | Farrell et al. | 220/258.2 |
| 5,069,355 | A * | 12/1991 | Matuszak | 220/270 |
| 5,328,045 | A | 7/1994 | Yoshida | |
| 5,353,943 | A | 10/1994 | Hayward | |
| 5,395,005 | A | 3/1995 | Yoshida | |
| 5,752,614 | A | 5/1998 | Nelson et al. | |
| 6,601,727 | B1 * | 8/2003 | Sauer et al. | 220/359.2 |

FOREIGN PATENT DOCUMENTS

| | | |
|---|---|---|
| EP | 0 306 982 A | 3/1989 |
| EP | 0 408 268 A | 1/1991 |
| GB | 2 244 254 A | 11/1991 |

* cited by examiner

*Primary Examiner*—Faye Francis
(74) *Attorney, Agent, or Firm*—Alston & Bird LLP

(57) ABSTRACT

A retortable container and an easy-opening closure for hermetic sealing of an open end thereof. The closure includes a metal end ring adapted to be double seamed to an open end of the retortable container, an intermediate area extending radially inward and defining an opening to an interior of the container, and a folded area folded into the interior of the container. The folded area extends radially outward from the opening and substantially parallel to at least an adjacent portion of the intermediate area. A first membrane patch overlaps and is bonded to an under side of the intermediate area of the end ring such that the first membrane patch prevents contamination of contents of the container by the metal end. A second membrane patch covers the opening and is bonded to an upper side of the first membrane patch. The bonds have predetermined shear and tensile force strengths sufficient to withstand shear and tensile forces created during retort processing of the container, while allowing easy-opening of the container by peeling the second membrane patch.

24 Claims, 2 Drawing Sheets

EASY-OPENING CLOSURE FOR RETORTABLE CONTAINER

BACKGROUND OF THE INVENTION

1) Field of the Invention

This invention relates to an easy-opening closure for hermetic sealing of an open end of a retortable container and an easy-opening container that is hermetically sealed by such a closure.

2) Description of Related Art

A variety of closures are known for the hermetic sealing of a container, such as conventional tin-plated steel cans that are widely used for containing food products. Retortable containers are those that can withstand a pasteurization or retort process comprising heat and pressure for preserving the food contents of the container. During retort, the container can be subjected to temperatures above 212° F. and up to 250° F. under pressures of 15 to 30 psi.

Easy-opening containers are those that can be opened without undue effort and without the use of a special tool such as a rotary can opener. In order for an easy-opening container to be retortable, the closure must be sufficiently strong to resist stresses that develop as a result of the retort heat and pressure but easily overcome during opening. One conventional easy-opening, retortable container includes a closure that is stronger in shear than tension. The closure is strong enough to withstand the shear force that develops during retort, while a relatively small tensile force is required to open the container. For example, U.S. Pat. No. 5,752,614, titled "Easy-Opening Closure for Hermetic Sealing a Retortable Container," to Nelson describes an easy-opening closure. The closure includes a metal end ring that is adapted to be seamed to an open end of a retortable container and defines a central opening of the container. An edge of the end ring that defines the central opening is preferably rolled. A membrane patch covers the opening and is bonded to the end ring. The bond is unaffected during retort processing, but has a predetermined tensile force strength that is preferably less than 5 psi to allow peeling of the membrane patch from the end ring. Thus, the container can be retorted and subsequently easily opened. However, because the rolled edge is positioned within the container, the contents of the container can contact the edge. Contaminants trapped within the rolled edge, for example, debris or moisture trapped during manufacture of the end ring, can be introduced into the container and thereby contaminate the contents. Additionally, corrosion of the edge can result, for example during retort, also resulting in contamination of the contents of the container. In some embodiments, a membrane ring, which extends from the end ring to the membrane patch, acts as a barrier between the edge and the contents of the container. During retort, however, gas and/or moisture contained in the rolled edge can expand and stress the bonds that hold the membrane ring to the end ring and the membrane patch. A failure of either bond can result in contamination of the contents, which can be difficult to detect without opening the container.

Another container closure known in the art includes a metal end ring R with a folded edge E, as shown in FIG. 2. The edge E is folded outward from the container, i.e., away from the contents of the container. Further, a membrane M is affixed to the ring R by a bond B such that the edge E is hermetically sealed from the contents of the container. By preventing contact between the edge E and the contents, the risk of corrosion of the edge and contamination of the contents is reduced, but contact between the edge E and the contents may occur after the closure is opened. Additionally, upon removing the membrane M, the folded edge E is exposed to the user, thereby detracting from the aesthetic appeal of the closure. Further, if the single bond B is strong enough to resist the pressures associated with retort, the bond may be difficult for the user to overcome to open the container.

Thus, there exists a need for an easy-opening closure for hermetically sealing an open end of a retortable container and an easy-opening container that is hermetically sealed by such a closure. The closure should be strong enough to withstand the stresses induced during retort, but easily removed by a user. Additionally, the closure should reduce the likelihood of contamination to the contents of the container, for example, during assembly of the container, during retort, and after opening the container.

BRIEF SUMMARY OF THE INVENTION

It is an object of the present invention to further improve the closure as described, for example, in the above Nelson patent, by providing a closure which resists the forces produced by internal pressures and temperatures during retort processing, yet which is easily operable by the consumer.

The present invention provides an easy-opening, retortable container for hermetic sealing and a closure for such a container. A metal end ring is folded into the container and a first membrane patch provides a barrier between an edge of the ring and the contents of the container. Advantageously, moisture, gas, and debris trapped by the end ring and/or the first membrane patch are minimized, and the risk of contamination of the contents of the container is reduced.

According to one embodiment, the container includes a base portion with a bottom and side that define an interior space and an open end that is closed by the closure. The closure includes the metal end ring, the first membrane patch, and a second membrane patch. The end ring has a deformable outside peripheral area adapted to be joined to the open end of the retortable container, for example, by a double seam. An intermediate area extends radially inward from the outside peripheral area and defines an opening to the interior of the container. A folded area is folded into the interior of the container and extends radially outward from the opening and substantially parallel to at least an adjacent portion of the intermediate area, for example, in abutting contact with the adjacent portion. The first membrane patch has an outside peripheral area attached to an under side of the intermediate area by a bond and an inside peripheral area extending inwardly into the opening, thus preventing contamination of contents of the container by the metal end. The second membrane patch covers the opening and has an outer peripheral area that overlaps and is attached to an upper side of the first membrane patch. The second membrane patch can also be bonded to the end ring. The bonds have predetermined shear and tensile force strengths sufficient to withstand shear and tensile forces created during retort processing of the container, while allowing easy opening of the container by peeling the second membrane patch. For example, each bond can have a shear force strength greater than 15 psi and a tensile force strength less than 5 psi. According to one aspect of the invention, each of the bonded surfaces is a polypropylene heat-sealable surface. Either of the first and second membrane patches can define one or more apertures therethrough.

According to another embodiment of the invention, the first membrane patch defines a fail portion, such as a circumferentially-extending score, disposed between the bonds with the end ring and the second membrane patch such that the first membrane patch tears at the fail portion when the second membrane patch is pulled from the closure.

BRIEF DESCRIPTION OF THE SEVERAL VIEWS OF THE DRAWINGS

Figure 1:
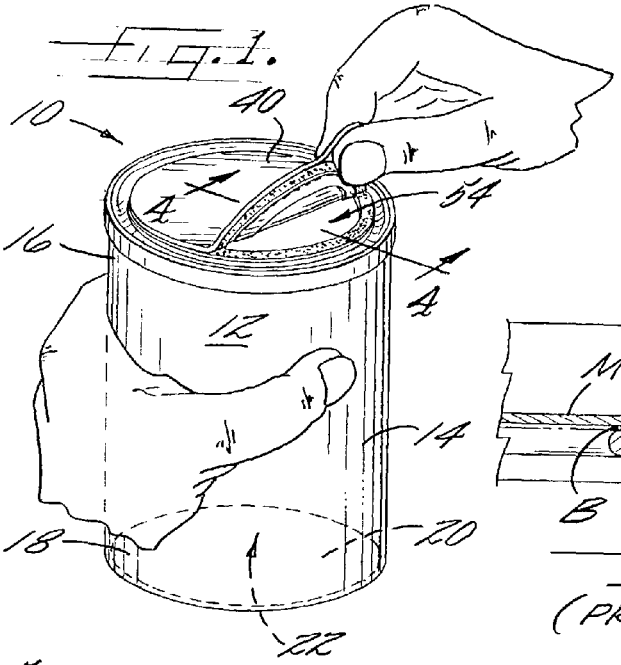
Figure 2:
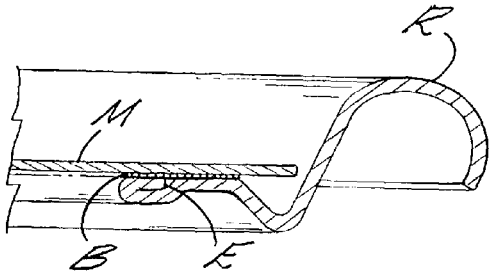
FIG. 2. (PRIOR ART)
Figure 3:
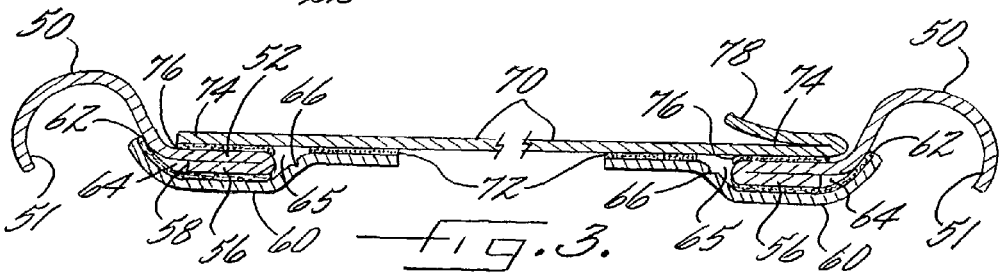
Figure 4:
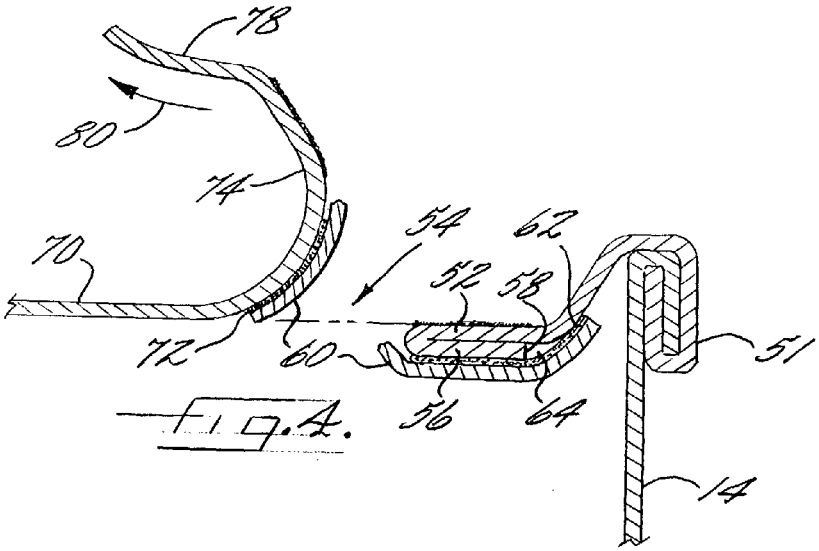
Figure 5:
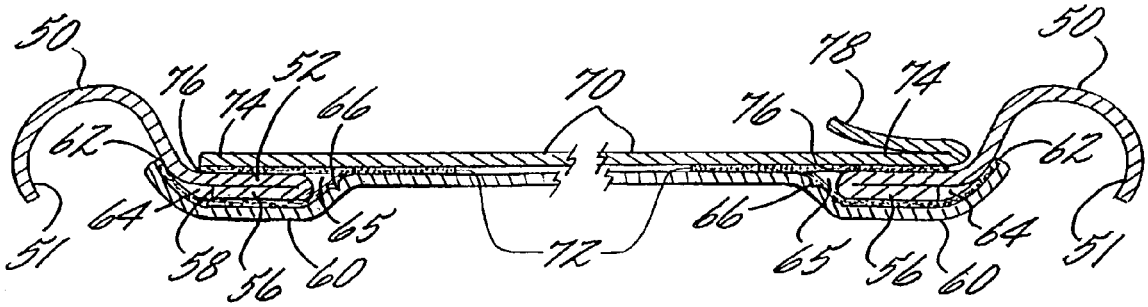

Having thus described the invention in general terms, reference will now be made to the accompanying drawings, which are not necessarily drawn to scale, and wherein:

FIG. 1 is a perspective view of an easy-opening, retortable container according to one embodiment of the present invention with a closure partially removed;

FIG. 2 is a partial sectional view in elevation of a closure as is known in the art;

FIG. 3 is a partial sectional view in elevation of the closure of the container of FIG. 1;

FIG. 4 is a partial sectional view in elevation of the closure of FIG. 1 as seen along line 4—4 of FIG. 1; and FIG. 5 is a partial sectional view in elevation of a closure according to another embodiment of the present invention.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Referring now to FIG. 1, there is shown an easy-opening, retortable container 10 according to one embodiment of the present invention, which includes-a base portion 12 and an easy-opening closure 40. The base portion 12 can be formed of a variety of materials, such as metals, including steel, aluminum, and tin, as well as plastic, cardboard, and laminates of multiple materials. In the illustrated embodiment, the base portion 12 includes a continuous cylindrical side 14 that extends longitudinally from an openable first end 16 to a second end 18, which is closed by a bottom 20. The side 14 can comprise alternative configurations, for example, multiple rectangular panels configured at right angles so that the base portion 12 has a square cross section instead of circular as shown. Additionally, the bottom 20 and the side 14 can be formed as a unitary member, or the bottom 20 can be formed separately from the side 14 and joined thereto, for example, by crimping, welding, gluing, and the like.

The openable first end 16 can be closed by the closure 40 such that the base portion 12 and the closure 40 define an interior space 22 therein, which can be hermetically sealed. As shown in FIG. 3, the closure 40 includes an end ring 50 that can have a deformable outside peripheral area 51, which is adapted to be joined to the openable end 16 of the base portion 12, for example, by a double seam extending around the circumference of the openable end 16 of the side 14, as shown in FIGS. 1 and 4. The end ring 50 can be formed of metals such as steel, tin, and aluminum, as well as other materials, and can be formed of the same material as the base portion 12 of the container 10. As shown in FIGS. 3 and 4, the end ring 50 defines an intermediate area 52 that extends radially inward to an opening 54. Preferably, the end ring 50 is folded at the opening 54, and a folded area 56 of the end ring 50 extends radially outward from the opening 54. The folded area 56 is folded into the interior space 22 of the container 10 so that a user is less likely to be exposed to an edge 58 of the end ring 50, thereby improving the safety and aesthetic appeal of the container 10. Further, the folded area 56 of the end ring 50 is preferably folded so that the folded area 56 is substantially parallel to and abuts at least a portion of the intermediate area 52.

The closure 40 also includes a first membrane patch 60, which can be bonded by a bond 62 to the end ring 50, for example, at the peripheral area 51, the intermediate area 52, and/or the folded area 56. For example, the first membrane patch 60 can extend radially outward from the opening 54, and the bond 62 can join the patch 60 to the intermediate area 52 and the folded area 56 so that the first membrane patch 60 provides a barrier between the interior space 22 of the container 10 and the edge 58 of the end ring 50. The first membrane patch 60 can be ring-shaped, as shown in FIGS. 3 and 4, so that the patch 60 defines an opening or aperture that is closely adjacent the opening 54. That is, the first membrane patch 60 can define an opening or aperture that allows access through the opening 54 to the contents of the container 10 when the container 10 is open. Alternatively, the first membrane patch 60 can be a continuous sheet of circular outline that does not define an aperture, so that the first membrane patch 60 hermetically seals the opening 54, as described below in connection with FIG. 5.

A second membrane patch 70 is disposed on the end ring 50 so that the patch 70 closes the opening 54, and preferably so that the patch 70 hermetically seals the opening 54. For example, the second membrane patch 70 can overlap a portion of the first membrane patch 60 as shown in FIG. 3, and a bond 72 can join the patches 60, 70 to close the opening 54. The second membrane 70 can also define an opening or aperture (not shown) that is closely adjacent the opening 54, but preferably at least one of the first and second membrane patches 60, 70 is a continuous sheet that seals the opening 54. The first membrane patch 60 and/or at least one of the bonds 62, 72 can be sufficiently weak so that the user can break the patch 60 or bond 62, 72 when opening the closure 40. Preferably, the first membrane patch 60 defines a fail portion, i.e., a weakened portion of the patch 60 that breaks or tears during opening. For example, the fail portion can be a score 66 disposed circumferentially on the patch 60 such that the bond 62 stays intact and continues to provide a barrier to the edge 58, even after the closure 40 is opened. Alternatively, the fail portion can comprise a relatively thin region or a perforation in the patch 60.

The second membrane patch 70 can also be of a sufficient size to cover the opening 54. An outer peripheral area 74 of the patch 70 can overlap the end ring 50, and a bond 76 can be provided for joining the patch 70 to the end ring 50, for example, an upper side of the intermediate area 52. Preferably, the volumes of enclosed spaces 64, 65 between the first membrane patch 60, the end ring 50, and the second membrane patch 70 are small so that expansion of gas and/or moisture contained by the spaces 64, 65 during retort does not break the bonds 62, 72, 76. For example, the folded area 56 can be folded against the intermediate area 52 to make contiguous abutting contact therewith, thus providing little or no space between the intermediate and folded areas 52, 56 and minimizing the volume of the spaces 64, 65. Minimizing the volumes of the spaces 64, 65 and the gap between the intermediate and folded areas 52, 56 in turn minimizes the moisture and/or gases trapped therein which would tend to expand and exert pressure on the bonds 62, 72, 76 during retort processing. The first and second membrane patches 60, 70 can comprise a variety of materials, including metal foils formed of tin or aluminum, polymers, or composite laminates. The second membrane patch 70 can also include a tab portion 78 or other member or feature for facilitating the user's grasp of the patch 70.

Preferably, the closure 40 provides a hermetic seal to the container 10 such that the container 10 can be used for storing food items and other items requiring a hermetic seal or a reduced or enhanced storage pressure. The bonds 62, 72, 76 can be sufficiently strong for resisting pressure developed in the container 10 during the retort process. Further, one or more of the bonds 62, 72, 76 can be strong enough to resist the pressure during the retort, but weak enough to allow the closure 10 to be easily opened by the user. For example, the bond 62 between the first membrane patch 60 and the end ring 50 can have a predetermined shear force strength of greater than 15 psi to resist pressure in the container 10 during retort. Similarly, the bonds 72, 76 between the first membrane patch 60, the second membrane patch 70, and the end ring 50 separately or in combination can have a predetermined shear force strength of greater than 15 psi. At least one of the bonds 62, 72, 76 preferably also has a sufficiently low tensile force strength to allow easy opening of the container 10. For example, the bond 76 between the second membrane patch 70 and the end ring 50 can have a tensile force strength of less than about 5 psi.

The bonds 62, 72, 76 can be formed by providing an adhesive or heat-sealable surfaces. In one preferred embodiment, the end ring 50 is formed of steel with a heat-sealable coating or laminate, for example, a polymer dispersion. The polymer is preferably one that can withstand the temperature and pressures associated with the retort process, such as polypropylene. The first membrane patch 60 can include one or more polypropylene heat-sealable surfaces, and the second membrane patch 70 can also comprise a polypropylene heat-sealable bottom surface. For example, the first membrane patch 60 can be formed of a multiple-layer material having an outside layer of polypropylene, and the second membrane patch 70 can include a polypropylene heat seal layer at least on the bottom thereof. The second membrane patch 70 can also include additional layers such as a foil backbone layer and one or more layers, such as a polyester laminate, on top of the foil layer for additional strength. The polypropylene heat seal layers can be cast polypropylene, blown polypropylene or can be in the form of a co-extrusion. With the use of a polypropylene bottom layer on the second membrane patch 70, polypropylene upper and lower layers on the first membrane patch 60, and polypropylene upper and lower layers on the end ring 50, each of the bonds 62, 72, 76 is a heat seal bond, which can be formed by heating and pressing together the heat-sealable surfaces. These heat seal bonds can vary between a fusion bond which gives the maximum strength in both shear and tensile, to a heat seal bond which provides sufficient strength in shear to resist the retort forces while being sufficiently weak in tension to allow peeling of the bond.

Further, the score 66 in the first membrane patch 60 can have a tensile force strength of less than about 5 psi. Thus, the closure 40 is strong enough to resist the pressure associated with the retort process, but allows the user to peel the second membrane patch 70 in a direction 80 from the container 10 without exerting an excessive force, thereby breaking or tearing the first membrane patch 60 at the score 66, as shown in FIG. 4. Instead of providing the score 66, one of the bonds 62, 72 that hold the first membrane patch 60 to the closure 40 can have a tensile force strength of less than 5 psi so that the respective bond 62, 72 can be released by the user instead of breaking the first membrane patch 60 at the score 66.

As shown in FIG. 5, the first membrane patch 60 can define a continuous sheet or membrane of material that hermetically seals the opening 54. The second membrane patch 70 can be a continuous sheet or can define one or more apertures (not shown) through which the first membrane patch 60 is exposed to the outside of the container 10. The materials used to form the patches 60, 70 can be selected in light of the configuration of the patches 60, 70 to minimize the cost and/or complexity of the container 10. For example, if the first membrane patch 60 hermetically seals the opening 54, as shown in FIG. 5, the first membrane patch 60 can be formed of a material suitable for sealing the container 10 and contacting the contents of the container 10, such as a polypropylene that has been approved by the Food and Drug Administration for such use in retortable containers. In that case, the first membrane patch 60 provides a barrier between the second membrane patch 70 and the contents of the container 10. Therefore, the second membrane patch 70 can be formed of a paper or metallic material, which may not be suitable for sealing the container 10 and contacting the contents of the container 10. The material for the second membrane 70 can be selected based according to such characteristics as cost, appearance, printability, and the like.

As shown in FIG. 5, the adhesive applied to form the bonds 62, 72, 76 can be disposed continuously on the membrane patches 60, 70 so that the adhesive extends, for example, between the bonds 62, 72 and between the bonds 72, 76. Further, the adhesive can fill or partially fill the enclosed spaces 64, 65, and the score 66 can be disposed under or through the adhesive.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An easy-opening closure for hermetic sealing of an open end of a retortable container, the closure comprising:

a metal end ring having a deformable outside peripheral area adapted to be joined to the open end of the retortable container, an intermediate area extending radially inward from said outside peripheral area and defining an opening to allow access therethrough to the interior of the container, and a folded area folded into the interior of the container and extending radially outward from said opening and substantially parallel to and in abutting contact with said intermediate area and so as to terminate in a metal end edge;

a first membrane patch having an outside peripheral area overlapping and attached to an under side of said intermediate area of said metal end ring at a portion of the intermediate area which does not overlie the folded area by a bond having predetermined shear and tensile force strengths, and being also bonded to the folded area such as to seal the metal end edge, and having an inside peripheral area extending inwardly into said opening; and a second membrane patch of sufficient size to cover said opening and having an outer peripheral area overlapping and attached to an upper side of said first membrane patch by a bond having predetermined shear and tensile force strengths;

wherein said predetermined shear and tensile force strengths of said bonds are sufficient to withstand shear and tensile forces created during retort processing of the container, while allowing easy-opening of the container by peeling said second membrane patch, and wherein said first membrane patch prevents contamination of contents of the container by said metal end edge.

2. An easy-opening closure according to claim 1 wherein the folded area and the adjacent portion of the metal end ring lie in parallel planes with substantially no space therebetween.

3. An easy-opening closure according to claim 1 wherein said bond between said first membrane patch and said metal end ring has a shear force strength of greater than 15 psi, and said bond between said second membrane patch and said first membrane patch has a shear force strength of greater than 15 psi and a tensile force strength of less than 5 psi.

4. An easy-opening closure according to claim 1 wherein said metal end ring comprises steel having polypropylene heat-sealable surfaces, said first membrane patch includes polypropylene heat-sealable surfaces, said second membrane patch comprises a layer having a polypropylene heat-sealable bottom surface, and said bonds comprise heat-sealed bonds.

5. An easy-opening closure according to claim 1 wherein said outer peripheral area of said second membrane patch also overlaps and is attached to an upper side of said intermediate area of said metal end ring by a bond which is unaffected during retort processing of the container and having a predetermined tensile force strength which allows peeling of said second membrane patch from said metal end ring.

6. An easy-opening closure according to claim 5 wherein said bond between said first membrane patch and said metal end ring has a shear force strength of greater than 15 psi, said bond between said second membrane patch and said first membrane patch has a shear force strength of greater than 15 psi and a tensile force strength of less than 5 psi, and said bond between said second membrane patch and said metal end ring has a tensile force strength of less than 5 psi.

7. An easy-opening closure according to claim 1 wherein said first membrane patch defines a fail portion disposed between said bonds, said fail portion being weaker than said bonds such that said first membrane patch tears at said fail portion when said second membrane patch is pulled from the closure.

8. An easy-opening closure according to claim 7 wherein said fail portion comprises a circumferentially-extending score located within said opening.

9. An easy-opening closure according to claim 1 wherein at least one of said first and second membrane patches defines an aperture that is closely adjacent said opening of said metal end ring.

10. An easy-opening closure for hermetic sealing of an open end of a retortable container, the closure comprising:

a metal end ring having a deformable outside peripheral area adapted to be double seamed to the open end of the retortable container, an intermediate area extending radially inward from said outside peripheral area and defining an opening to allow access therethrough to the interior of the container, and a folded area folded into the interior of the container against said intermediate area and extending radially outward from said opening and parallel to and in abutting contact with said intermediate area and so as to terminate in a metal end edge;

a first membrane patch having an outside peripheral area overlapping and attached to an under side of said intermediate area of said metal end ring at a portion of the intermediate area which does not overlie the folded area by a bond having predetermined shear and tensile force strengths, and being also bonded to the folded area such as to seal the metal end edge, and having an inside peripheral area extending inwardly into said opening; and a second membrane patch of sufficient size to cover said opening and having an outer peripheral area overlapping and attached to an upper side of said first membrane patch by a bond having predetermined shear and tensile force strengths;

wherein said outer peripheral area of said second membrane patch also overlaps and is attached to an upper side of said intermediate area of said metal end ring by a bond having predetermined shear and tensile force strengths and wherein said predetermined shear and tensile force strength of said bonds are sufficient to withstand shear and tensile forces created during retort processing of the container while allowing easy-opening of the container by peeling said second membrane parch, and wherein said first membrane parch prevents contamination of contents of the container by said metal end edge.

11. An easy-opening closure according to claim 10 wherein said bond between said first membrane patch and said metal end ring has a shear force strength of greater than 15 psi, said bond between said second membrane patch and said first membrane patch has a shear force strength of greater than 15 psi and a tensile force strength of less than 5 psi, and said bond between said second membrane patch and said metal end ring has a tensile force strength of less than 5 psi.

12. An easy-opening closure according to claim 10 wherein said metal end ring comprises steel having polypropylene heat-sealable surfaces, said first membrane patch includes polypropylene heat-sealable surfaces, said second membrane patch comprises a layer having a polypropylene heat-sealable bottom surface, and said bonds comprise heat-sealed bonds.

13. An easy-opening closure according to claim 13 wherein said first membrane patch defines a fail portion disposed between said bond between said first membrane patch and said metal end ring and said bond between the first membrane patch and the second membrane patch, said fail portion being weaker than said bonds such that said first membrane patch tears at said fail portion when said second membrane patch is pulled from the closure.

14. An easy-opening closure according to claim 13 wherein said fail portion comprises a circumferentially-extending score located within said opening.

15. An easy-opening, retortable container comprising:

a base portion having a bottom and side that define an open end and an interior space and;

a metal end ring having an outside peripheral area double seamed to the open end of said base portion, an intermediate area extending radially inward from said outside peripheral area and defining an opening to allow access therethrough to the interior space, and a folded area folded into the interior space and extending radially outward from said opening and substantially parallel to and in abutting contact with said intermediate area and so as to terminate in a metal end edge;

a first membrane patch having an outside peripheral area overlapping and attached to an under side of said intermediate area of said metal end ring at a portion of the intermediate area which does not overlie the folded area by a bond having predetermined shear and tensile force strengths, and being also bonded to the folded area such as to seal the metal end edge, and having an inside peripheral area extending inwardly into said opening; and a second membrane patch of sufficient size to cover said opening and having an outer peripheral area overlapping and attached to an upper side of said first membrane patch by a bond having predetermined shear and tensile force strengths, wherein said predetermined shear and tensile force strength of said bonds are sufficient to withstand shear and tensile forces created during retort processing of the container, while allowing easy-opening of the container by peeling said second membrane patch, and wherein said first membrane patch prevents contamination of contents of the container by said metal end edge.

16. An easy-opening, retortable container according to claim 15 wherein said folded area and said adjacent portion of said metal end ring lie in parallel planes with substantially no space therebetween.

17. An easy-opening, retortable container according to claim 15 wherein said bond between said first membrane patch and said metal end ring has a shear force strength of greater than 15 psi, and said bond between said second membrane patch and said first membrane patch has a shear force strength of greater than 15 psi and a tensile force strength of less than 5 psi.

18. An easy-opening, retortable container according to claim 15 wherein said metal end ring comprises steel having polypropylene heat-sealable surfaces, said first membrane patch includes polypropylene heat-sealable surfaces, said second membrane patch comprises a layer having a polypropylene heat-sealable bottom surface, and said bonds comprise heat-sealed bonds.

19. An easy-opening, retortable container according to claim 15 wherein said outer peripheral area of said second membrane patch also overlaps and is attached to an upper side of said intermediate area of said metal end ring by a bond which is unaffected during retort processing of the container and having a predetermined tensile force strength which allows peeling of said second membrane patch from said metal end ring.

20. An easy-opening, retortable container according to claim 19 wherein said bond between said first membrane patch and said metal end ring has a shear force strength of greater than 15 psi, said bond between said second membrane patch and said first membrane patch has a shear force strength of greater than 15 psi and a tensile force strength of less than 5 psi, and said bond between said second membrane patch and said metal end ring has a tensile force strength of less than 5 psi.

21. An easy-opening, retortable container according to claim 15 wherein said first membrane patch defines a fall portion disposed between said bonds, said fail portion being weaker than said bonds such that said first membrane patch tears at said fail portion when said second membrane parch is pulled from the closure and wherein said fail portion comprises a circumferentially-extending score.

22. An easy-opening, retortable container according to claim 15 wherein at least one of said first and second membrane patches defines an aperture that is closely adjacent said opening of said metal end ring.

23. An easy-opening closure according to claim 1 wherein said first membrane patch extends radially outwardly beyond said metal end edge such that said metal end edge is disposed between said first membrane patch and said intermediate area of said metal end ring.

24. An easy-opening, retortable container according to claim 15 wherein said first membrane patch extends radially outwardly beyond said metal end edge such that said metal end edge is disposed between said first membrane patch and said intermediate area of said metal end ring.

* * * * *

UNITED STATES PATENT AND TRADEMARK OFFICE

CERTIFICATE OF CORRECTION

PATENT NO. : 7,055,713 B2
APPLICATION NO. : 10/292842
DATED : June 6, 2006
INVENTOR(S) : Rea et al.

It is certified that error appears in the above-identified patent and that said Letters Patent is hereby corrected as shown below:

Column 8,
Line 28, “parch” should read --patch--.

Column 10,
Line 20, “fall” should read --fail--;
Line 23, “parch” should read --patch--.

Signed and Sealed this

Ninth Day of January, 2007

JON W. DUDAS
*Director of the United States Patent and Trademark Office*